United States Patent [19]

Foreman

[11] Patent Number: 4,630,622

[45] Date of Patent: Dec. 23, 1986

[54] HAIR ROLLING DEVICE

[76] Inventor: Adele J. Foreman, 1502 Puls, Oceanside, Calif. 92054

[21] Appl. No.: 627,058

[22] Filed: Jul. 2, 1984

[51] Int. Cl.[4] ..... A45D 2/02

[52] U.S. Cl. ..... 132/39; 132/42 R; 132/44

[58] Field of Search ..... 132/33, 39, 40, 41 R, 132/41 A, 41 B, 41 C, 42 R, 42 A, 43 R, 43 A, 44

[56] References Cited

U.S. PATENT DOCUMENTS

| | | | |
|---|---|---|---|
| 1,619,743 | 3/1927 | McClaire | 132/43 R |
| 2,061,356 | 11/1936 | Gosewisch | 132/42 A |
| 2,391,284 | 12/1945 | Weiss | 132/42 R |
| 2,423,420 | 7/1947 | Talbot | 132/40 |
| 2,525,750 | 10/1950 | Spencer | 132/42 R |
| 2,747,585 | 5/1956 | Allen | 132/42 R |
| 2,793,645 | 5/1957 | Grant | 132/41 R |
| 3,056,413 | 10/1962 | Unger | 132/42 R |
| 3,092,118 | 6/1963 | Otto | 132/40 |
| 3,139,889 | 7/1964 | Buzzelli | 132/39 |
| 3,316,920 | 5/1967 | Cruise | 132/39 |
| 3,415,255 | 12/1968 | Mitsumoto | 132/39 |
| 4,310,008 | 1/1982 | Lalli | 132/40 |

FOREIGN PATENT DOCUMENTS

| | | | |
|---|---|---|---|
| 863629 | 4/1941 | France | 132/42 R |

*Primary Examiner*—John J. Wilson

*Attorney, Agent, or Firm*—Duane C. Bowen

[57] ABSTRACT

A foam roller around which hair is tightly wound and clamped in place having a fabric sleeve interposed between the foam and the hair reducing the coefficient of friction to below 1.00 and preferably under 0.900, as compared to foam coefficient of friction substantially above 1.00, in order to reduce hair breakage by facilitating hair slippage to adjust to roller re-expansion pressure. The plastic tube supporting the foam roller made of resilient, flexible material to be more comfortable when subjected to head weight when the user reclines.

1 Claim, 5 Drawing Figures

Fig. 1
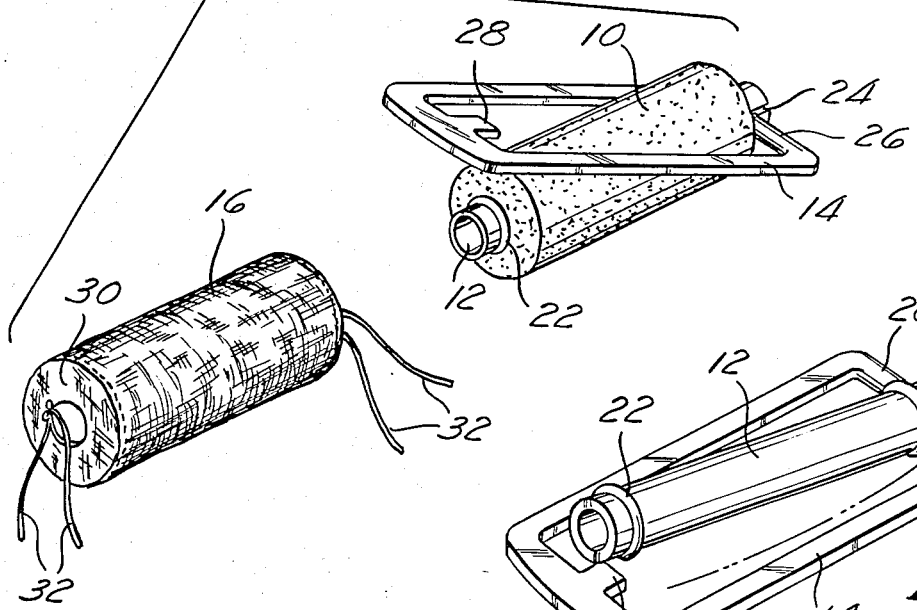
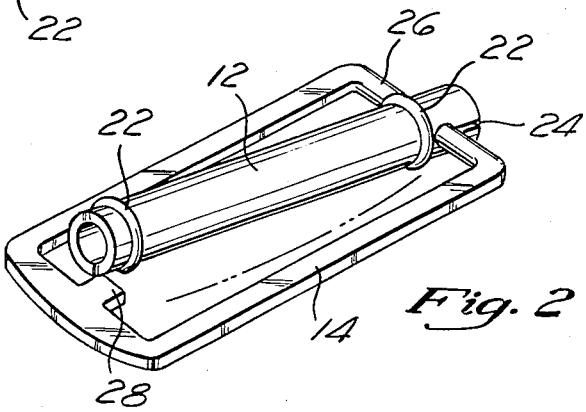
Fig. 2
Fig. 3
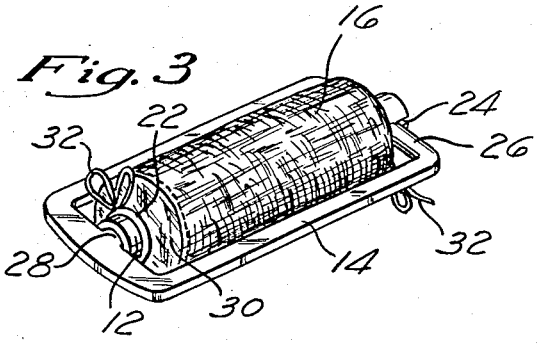
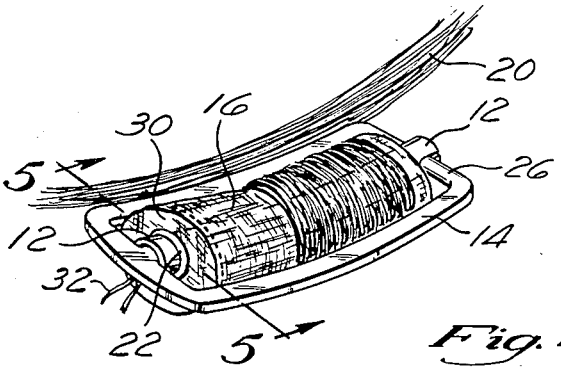
Fig. 4
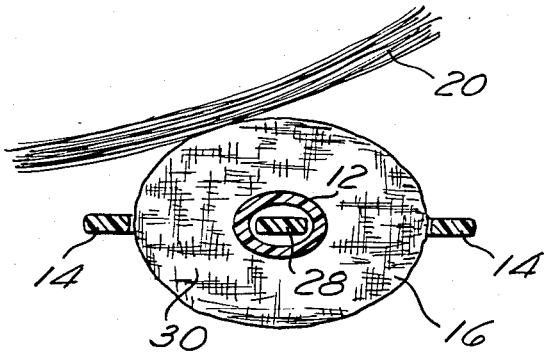
Fig. 5

HAIR ROLLING DEVICE

BRIEF SUMMARY OF INVENTION

Background and Objectives

My invention relates to a resilient foam roller around which hair is tightly wound and relates to the use of a fabric sleeve enclosing the sides of the roller to reduce the coefficient of friction of the surface the hair is wound upon to less than 0.900.

When hair is tightly wound upon a foam roller, dry, particularly for overnight treatment, there is an undue amount of breakage and splitting of hair because the roller tends to re-expand to its original shape and the friction between the hair and the foam roller is so high that the hair does not slip on the roller to accommodate roller expansion and the hair has a high breakage and splitting rate. This is particularly true of the kinky hair of black people that has a higher coefficient of friction that much of the straighter hair of people of other races. It is an objective of my invention to provide a hair rolling device to reduce hair breakage and splitting.

Further objectives include: to reduce friction of a foam hair roller by the use of a fabric sleeve covering the sides of the roller; and to provide a solution to the above problem that is economical to manufacture and practical to use.

My invention will be best understood together with additional objectives and advantages thereof from the following description, read with reference to the drawings, in which:

THE DRAWINGS

FIG. 1 is an exploded perspective view of the components of a specific embodiment of my invention including a foam roller, hair clamping means, and a fabric sleeve.

FIG. 2 is an enlarged perspective view of a tube to support the foam roller and of the hair clamping means in disengaged position.

FIG. 3 is a perspective view of roller and sleeve and of the hair clamping means in engaged, clamping position.

FIG. 4 is a perspective view of the hair rolling device with hair rolled thereon and with a head resting thereon.

FIG. 5 is an enlarged view, partly in section, taken on line 5—5 of FIG. 4.

DESCRIPTION

My hair rolling device includes a foam roller 10, a central plastic tube 12 supporting roller 10, and a plastic hair clamp 14 which largely resemble those presently being marketed. Roller 10 could be a rubber or a plastic foam. Tube 12 and clamp 14 can be made of a suitable plastic. The material forming fabric sleeve 16 will be discussed later.

In the prior clamps presently on the market, tube 12 is rigid. I specify a tube 12 which can flex in bending of its longitudinal axis, as shown in FIG. 4, and which can resiliently distort in cross-section as shown in FIG. 5, both under the weight of a head 20. The purpose of making tube 12 flexible and resilient is to provide more give so as to be more comfortable when the head may rest on rollers in overnight sleeping. The bending of tube 12 to conform somewhat to the curvature of a head 20 is illustrated in FIG. 4. Tube 12 is normally of circular cross-section and FIG. 5 shows a distortion of tube

12 under the weight of a head 20 to an elliptical cross-section. Allowance for flexibility and resilience in tube 12 can involve selection of a more pliable plastic material than in hair rollers presently on the market and also can involve thinner walls.

Other than the forming of tube 12 of a flexible resilient material, tube 12 and clamp 14 can have largely conventional construction. In the form illustrated, tube 12 has annular ribs 22 to keep foam roller 10 from shifting especially when fabric sleeve 16 is being installed or removed. Roller 10 instead could be bonded in place. The keyhole-shaped slot 24 in tube 12 pivotally connects to the end 26 of clamp 14 and the other end of tube 12 engages and disengages lug 28 on clamp 14 to clamp or release hair relative to roller 10.

Sleeve 16 is shown as having a generally cylindrical portion enclosing the sides of roller 10 and end portions 30 gathered by drawstrings 32 in hems (not shown) to secure or removably secure sleeve 16 in place when knotted. It will be understood that sleeve 16, including ends 30, is tubular so that roller 10 can be inserted therein, whereupon drawstrings 32 can be used to gather ends 30. Drawstrings 32 would permit removal and washing of sleeve 16. However, sleeve 16 could be bonded in place and not be removable, so that either the sleeve could be laundered or the sleeve could be laundered with roller 10 in place. Further, there are other ways to removably fasten a fabric sleeve to a roller, i.e., clamps for end portion 30 rather than drawstrings 32. The purpose of fabric sleeve 16 is to reduce friction on hair compared with an uncovered foam roller 10. The following discussion will refer to friction in terms of "coefficient of friction". When the term "coefficient of friction" is used in the specification and claims, the expression means "coefficient of static friction" according to the industrial standard in which friction is determined by the inclined plane method. A metal block (approx. 547 g, 3.1 sq. in. surface area) faced with the same fabric is placed on the fabric sample. The plane is elevated at a rate of 1°/sec. until sliding of the block occurs. The angle at which sliding occurs and the tangent of the angle (coefficient of sliding friction) are reported. The angle of inclination is measured to the nearest 0.5°.

The California Division of United States Testing Company, Inc., 5555 Telegraph Road, Los Angeles, Calif. 90040, was retained to measure the coefficient of friction, according to the above method, on samples of fabric and on uncovered foam material. That company reported they were unable to obtain a coefficient of friction reading on the foam material because the foam material would not slide. The foam material instead would fall or roll over at 45 or 46 degrees or more, signifying a coefficient of friction substantially in excess of 1.00. How much larger could not be determined.

The results of testing reported by the Company of fabric materials was as follows:

| | Coefficient of Static Friction | |
|---|---|---|
| | Average | |
| Sample | Angle, Degrees | Coefficient of Friction |
| Polyester Taffeta | 33.5 | 0.661 |
| Satin | 23.5 | 0.435 |
| Polyester Silk | 23.0 | 0.424 |
| Interlock Polyester | 35.5 | 0.713 |
| Polished Cotton | 40.0 | 0.839 |

-continued

| Coefficient of Static Friction | | |
|---|---|---|
| | Average | |
| Sample | Angle, Degrees | Coefficient of Friction |
| Doubleknit Polyester | 33.0 | 0.649 |

The test was performed in the warp direction only.

Following the results of this testing, I specify that the coefficient of friction of the fabric should be below 1.00. From the foregoing it will be seen that it would be easy to select a fabric with a coefficient of friction below 0.900 and that is my preferred range.

Other considerations can be involved in selection of a fabric besides coefficient of friction. Good results have been obtained with polyester taffeta. Some natural silks, for example, may lack durability. I prefer polyester taffeta, satin and polyester silk for physical characteristics but satin would need dry cleaning and polyester silk is expensive. Next in preference would be tricot or interlock polyester. Not preferred are polished cotton and regular cotton. Doubleknit polyester and linen are not recommended.

Note that the coefficient of friction is not a linear function, i.e., there is more increase of friction from 0.900 to 1.000 than from 0.400 to 0.500, etc.

Experimentation with fabric covered rollers has established a much lower rate of hair breakage by use of fabric covered rollers, so the improvement is real and not just theoretical. As has been indicated above, the kinky hair common to black people has a high friction, i.e., has increased resistance to slippage to adjust to foam roller pressure to restore to normal condition after the hair has been tightly wound on the roller. Use of my fabric covered rollers dramatically reduces breakage and splitting of hair of black people according to experimental results.

As the coefficient of friction of the roller is the important thing in reducing hair breakage, any surface treatment of the foam rollers or any coating of the rollers or any new foam formulation or foam processing that can achieve a surface coefficient of friction below 1.000 or preferably 0.900 or less, without a fabric sleeve, can be substituted for fabric coverage of foam rollers.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. The improvement to reduce friction in a hair rolling device in which there is a resilient plastic foam roller having working surfaces around which hair is tightly wound and securing means operative to clamp in place hair wound around said roller, comprising:

(a) a fabric sleeve directly fitting and completely covering said working surfaces of said roller and drawstrings at the end of said sleeve releasably securing said sleeve to said roller, the fabric of said sleeve having a coefficient of static friction less than 0.900 that is lower than the coefficient of static friction of the surface of said foam roller which is substantially above 1.00 whereby hair wound around said sleeve will have less breakage than hair wound directly around said roller because hair can slip more easily in contact with said fabric than in direct contact with said foam roller under pressure of said roller tending to restore its original shape, and (b) a plastic hollow longitudinally-open single-walled tube on which said foam roller is mounted, said plastic tube being sufficiently resilient to collapse and to flex longitudinally under the weight of the head of a reclining user, so as to be more comfortable to such a reclining user than a rigid tube.

* * * * *